United States Patent [19]

Whitear

[11] Patent Number: 4,964,744

[45] Date of Patent: Oct. 23, 1990

[54] LOTION APPLICATOR WITH REWINDING SPOOL

[76] Inventor: Frank W. Whitear, 21071 Gary Dr., #201, Hayward, Calif. 94546

[21] Appl. No.: 411,648

[22] Filed: Sep. 25, 1989

[51] Int. Cl.[5] ..... A45D 34/00

[52] U.S. Cl. ..... 401/6; 239/48; 239/52; 401/99

[58] Field of Search ..... 239/44, 47, 48, 50, 239/52; 401/6, 99

[56] References Cited

U.S. PATENT DOCUMENTS 1,777,820 10/1930 Anenberg ..... 239/48

4,788,787 12/1988 Konietzki ..... 239/48 X

FOREIGN PATENT DOCUMENTS 82909 2/1953 Norway ..... 239/47

*Primary Examiner*—Steven A. Bratlie

*Attorney, Agent, or Firm*—Linval B. Castle

[57] ABSTRACT

A shell-shaped lotion applicator, particularly for beach use, includes a lotion bottle containing a self-rewinding spool having thereon a elongated saturable wick with one end attached to the spool and the other end attached to the bottle stopper which is also a handle formed as a part of the shell.

4 Claims, 1 Drawing Sheet

LOTION APPLICATOR WITH REWINDING SPOOL

BRIEF SUMMARY OF THE INVENTION

This invention relates to a lotion bottle and applicator and particularly to a novel ornamental shell-shaped bottle having a long self-retracting wick which is extended to apply thick fluid lotions to the back and other areas of a body.

The bottle/applicator is very useful for the application of suntan or burn lotions, particularly to apply such lotions to body areas not normally within the reach. The applicator may be of any convenient size and, in its preferred embodiment, is of a size suitable for carrying in a beach bag or large purse and contains about one pint of fluid.

The bottle/applicator in the form of a shell is opened at the base which forms a handle for withdrawing the self-retracting wick applicator which is stored in the bottle and soaking in the lotion. The handle is sealed against leakage of the lotion from the bottle by an 0-ring and, upon removing the handle, the ribbon-like wick unwinds its self-rewinding spool within the bottle.

DESCRIPTION OF THE DRAWINGS

In the drawings which illustrate the preferred embodiment of the invention.

DETAILED DESCRIPTION OF THE PREFERRED EMBODIMENT

Figure 1:
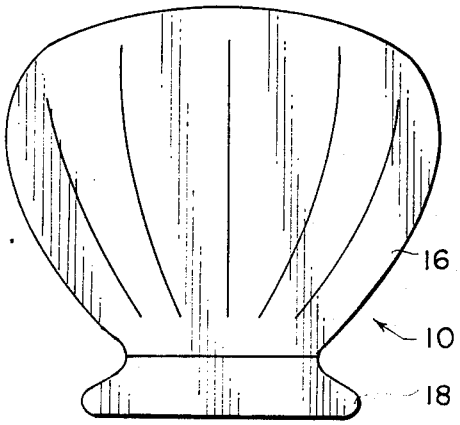
FIG. 1 is a side elevational view of the exterior of the lotion applicator.
Figure 2:
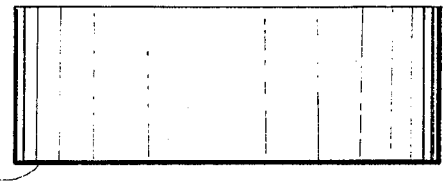
FIG. 2 is a top plan view thereof.
Figure 3:
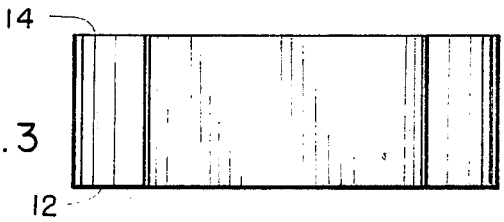
FIG. 3 is a bottom plan view thereof.

The lotion applicator bottle 10 illustrated in FIG. 1 is preferably a hollow plastic bottle shaped as a scallop shell about six inches in width and height and about 1-¼ inches in thickness. In the illustrated embodiment, the side surfaces are planar with added ornamental colors and designs of a shell, but may have raised surfaces to better emulate the designs of a shell. The planar side surfaces 12, 14, are better shown in the plan drawings of FIGS. 2 and 3.

Figure 4:
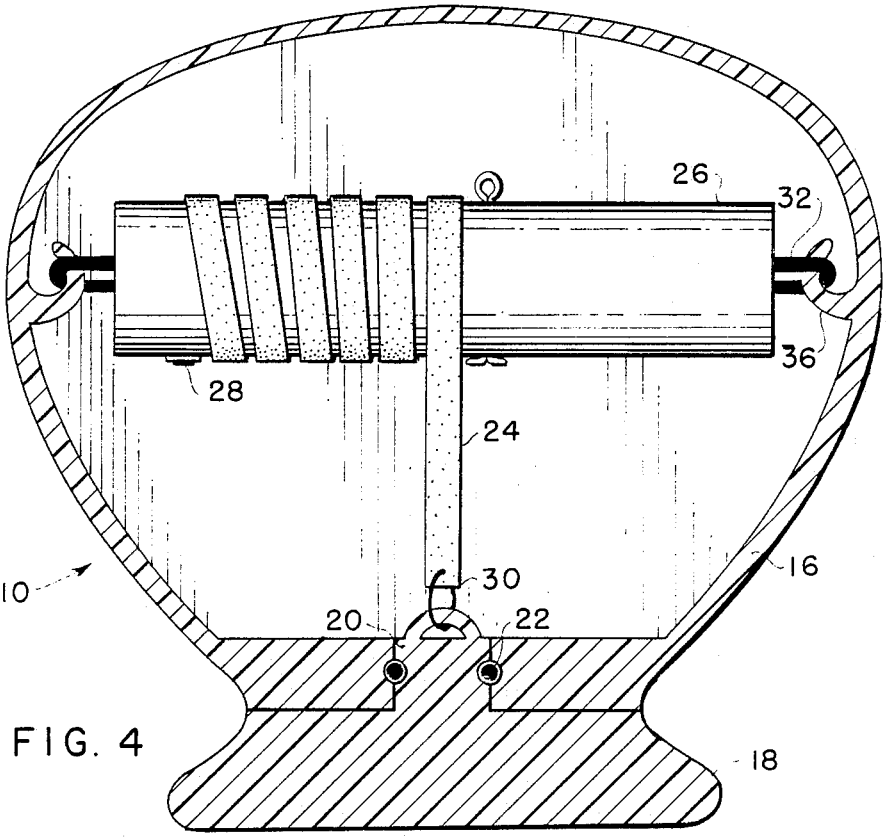
FIG. 4 is a sectional side elevational view illustrating the interior of the bottle/applicator.

The applicator bottle is formed of a main container 16 that is sealed to prevent leakage of thick lotions from the bottle, and a handle 18 which serves as bottle stopper 20 that plugs and seals the circular opening 22 in the bottom of the bottle as shown in FIG. 4. A pliable 0-ring between the stopper 20 and bottle opening 22 provides the proper seal between bottle and stopper.

The handle 18 which serves as the bottle stopper and the ornamental base to the shell shaped bottle also serves as a handle for withdrawing a fluid saturable ribbon wick 24 which is wrapped around a self-rewinding spool 26 spring mounted on an axis perpendicular to the axis of the bottle opening 22. The wick 24 is about one inch in width and eighteen inches in length and the spool 26 is about one inch in diameter and five inches in length. One end 28 of the wick 24 is secured to the spool surface near one end thereof; the opposite end 30 is coupled by a wire loop to the bottle stopper 20 so that withdrawal of the handle 18 will also withdraw the wick 24.

Figure 5:
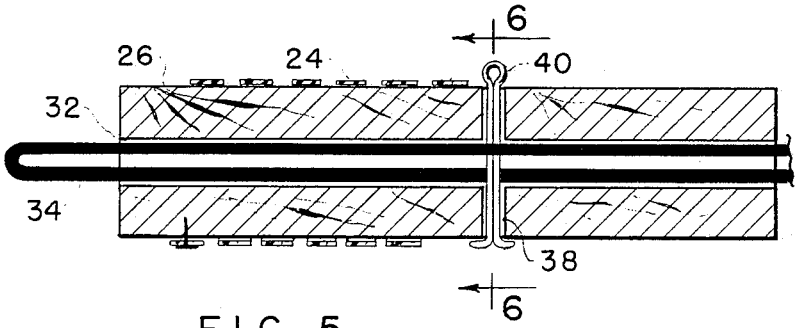
FIG. 5 is a sectional view of the self-rewinding spool.

The self-rewinding spool 26 is tubular, having a circular exterior and an axial hole 32 through its length. A strong rubber band 34 passes through the central axial hole and is secured at each end to connecting elements 36 in the interior of the main container 16 so that the band 34 and spool is positioned across the container substantially perpendicular to the vertical axis passing through the center of the bottle stopper 20, as shown in FIG. 5.

Figure 6:
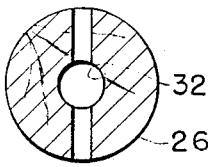
FIG. 6 is a sectional view taken along the lines 6—6 of FIG. 5.

The spool 26 also has a central hole 38 through its diameter as shown in FIG. 6.. This hole receives a pin 40 which passes through the separated strands of the rubber band 34 to prevent the spool 26 from freely rotating without winding the band and also to provide the necessary torque to rewind the withdrawn ribbon wick 24.

Having thus described my invention, what I claim is as follows:

1. A lotion applicator for the storage and dispensing of thick fluid lotion, said applicator comprising:

an ornamental fluid storage bottle having a circular opening on a longitudinal axis into said bottle;

a stopper for sealing said circular opening, said stopper being on a handle forming a part of the ornamental design of said bottle;

a spring biased, self-rewinding spool secured within said bottle, said spool being rotatable about a lateral axis normal to said longitudinal axis of said circular opening; and an elongated, ribbon-like, maturable, dispensing wick wound on said spool, said wick having a first end attached to said spool and a second end attached to said stopper.

2. The lotion applicator claimed in claim 1 wherein said spool has a tubular bore and is supported on a heavy elastic member passing through said bore and connected to hooks in the opposite interior walls of said bottle, rotation of said spool by withdrawing and unwinding of said wick causing the twisting of said elastic member and production of a rewinding torque.

3. The lotion applicator claimed in claim 2 wherein said stopper is removably sealed to said circular opening with an O-ring.

4. The lotion applicator claimed in claim 1 wherein said bottle is formed as the large arcuate part of a seal scallop shell and wherein said handle is formed as the remaining lower part of said shell.

* * * * *